US007428829B2

(12) United States Patent
Lueckenbach

(10) Patent No.: US 7,428,829 B2
(45) Date of Patent: Sep. 30, 2008

(54) CLOTHES WASHER FILLING CONTROL SYSTEMS AND METHODS

(75) Inventor: William Henry Lueckenbach, Charlottesville, VA (US)

(73) Assignee: General Electric Company, Schenectady, NY (US)

( * ) Notice: Subject to any disclaimer, the term of this patent is extended or adjusted under 35 U.S.C. 154(b) by 33 days.

(21) Appl. No.: 10/610,129

(22) Filed: Jun. 30, 2003

(65) Prior Publication Data

US 2004/0261468 A1 Dec. 30, 2004

(51) Int. Cl.
*D06F 33/02* (2006.01)

(52) U.S. Cl. ..... 68/12.02; 68/12.05; 68/12.21; 68/207

(58) Field of Classification Search ..... 68/12.01, 68/12.02, 12.05, 12.21, 2, 207; 137/387, 137/392, 453; 8/158, 159
See application file for complete search history.

(56) References Cited

U.S. PATENT DOCUMENTS 4,201,240 A 5/1980 Case
4,412,284 A * 10/1983 Kerforne et al. ..... 714/22
4,451,823 A * 5/1984 Penn et al. ..... 340/648
4,503,575 A * 3/1985 Knoop et al. ..... 8/158
4,733,798 A * 3/1988 Brady et al. ..... 222/23
4,835,991 A 6/1989 Knoop et al.
4,972,134 A * 11/1990 Getz et al. ..... 318/817
5,072,473 A * 12/1991 Thuruta et al. ..... 8/159
5,719,556 A * 2/1998 Albin et al. ..... 340/618
5,768,729 A 6/1998 Cracraft
6,125,870 A * 10/2000 Furmanek ..... 137/2
6,489,895 B1 * 12/2002 Apelman ..... 340/605
2002/0149396 A1 * 10/2002 Mizuhara et al. ..... 327/1

* cited by examiner

*Primary Examiner*—Frankie L Stinson
(74) *Attorney, Agent, or Firm*—George L. Rideout, Esq.; Armstrong Teasdale LLP

(57) ABSTRACT

A circuit is provided. The circuit includes a processor programmed to prevent overfilling of a cabinet with a fluid and a backup circuit having fixed logic. The backup circuit is electrically coupled to the processor to redundantly prevent overfilling the cabinet with the fluid.

18 Claims, 4 Drawing Sheets

CLOTHES WASHER FILLING CONTROL SYSTEMS AND METHODS

BACKGROUND OF THE INVENTION

This invention relates generally to washing machines, and more particularly, to methods and apparatus for controlling wash temperatures.

Washing machines typically include a cabinet that houses an outer tub for containing wash and rinse water, a perforated clothes basket within the tub, and an agitator within the basket. A drive and motor assembly is mounted underneath the stationary outer tub to rotate the basket and the agitator relative to one another, and a pump assembly pumps water from the tub to a drain to execute a wash cycle.

At least some known washing machines provide that an operator can select from three wash temperatures. Such machines have valve systems including hot and cold water valves. For a hot wash operation, for example, the hot water valve is turned on, i.e., opened, and for a cold wash operation, the cold valve is opened. For a warm wash, both the hot valve and cold valve are opened. The flow rates of water through the valves is selected so that the desired warm temperature is achieved using hot and cold water.

The use of a pressure sensor to measure water level allows for more accurate control of multiple water levels compared to the use of a pressure switch. Unfortunately, this provides an opportunity for a single point error in the microprocessor hardware, or software to generate an over fill condition. At least one known system externally monitors the pressure sensor signal and generates a signal that opens a relay that breaks the line voltage to the water valve. The use of a relay adds a cost to the circuit.

BRIEF DESCRIPTION OF THE INVENTION

In one aspect, a circuit is provided. The circuit includes a processor programmed to prevent overfilling of a cabinet with a fluid, and a backup circuit having fixed logic. The backup circuit is electrically coupled to the processor to redundantly prevent overfilling the cabinet with the fluid.

In another aspect, a washer overfill protection system is provided. The washer overfill protection system includes a pressure sensor configured to generate a variable frequency signal that is proportional to the fluid level of the washer, a converter electrically coupled to the pressure sensor, the converter is configured to generate an voltage that is proportional to the frequency of the output of the pressure sensor, and a microprocessor electrically coupled to the converter. The microprocessor is configured to calculate the fluid level from the voltage of the converter, and the microprocessor is electrically coupled to a fluid valve. The washer overfill protection system further includes a backup circuit having fixed logic. The backup circuit is electrically coupled to the converter and the fluid valve. The backup circuit is configured to at least one of turn on the fluid valve and turn off the fluid valve when the microprocessor fails.

In a further aspect, a washing machine is provided. The washing machine includes a cabinet, a tub and basket mounted within the cabinet, a cold water valve for controlling flow of cold water to the tub, a hot water valve for controlling flow of hot water to the tub, and a circuit coupled to at least one of the hot water valve and the cold water valve to control opening and closing of the hot and cold water valves. The circuit includes a processor programmed to prevent overfilling of the cabinet and a backup circuit having fixed logic. The backup circuit is electrically coupled to the processor to redundantly prevent overfilling the cabinet.

DETAILED DESCRIPTION OF THE INVENTION

Figure 1:
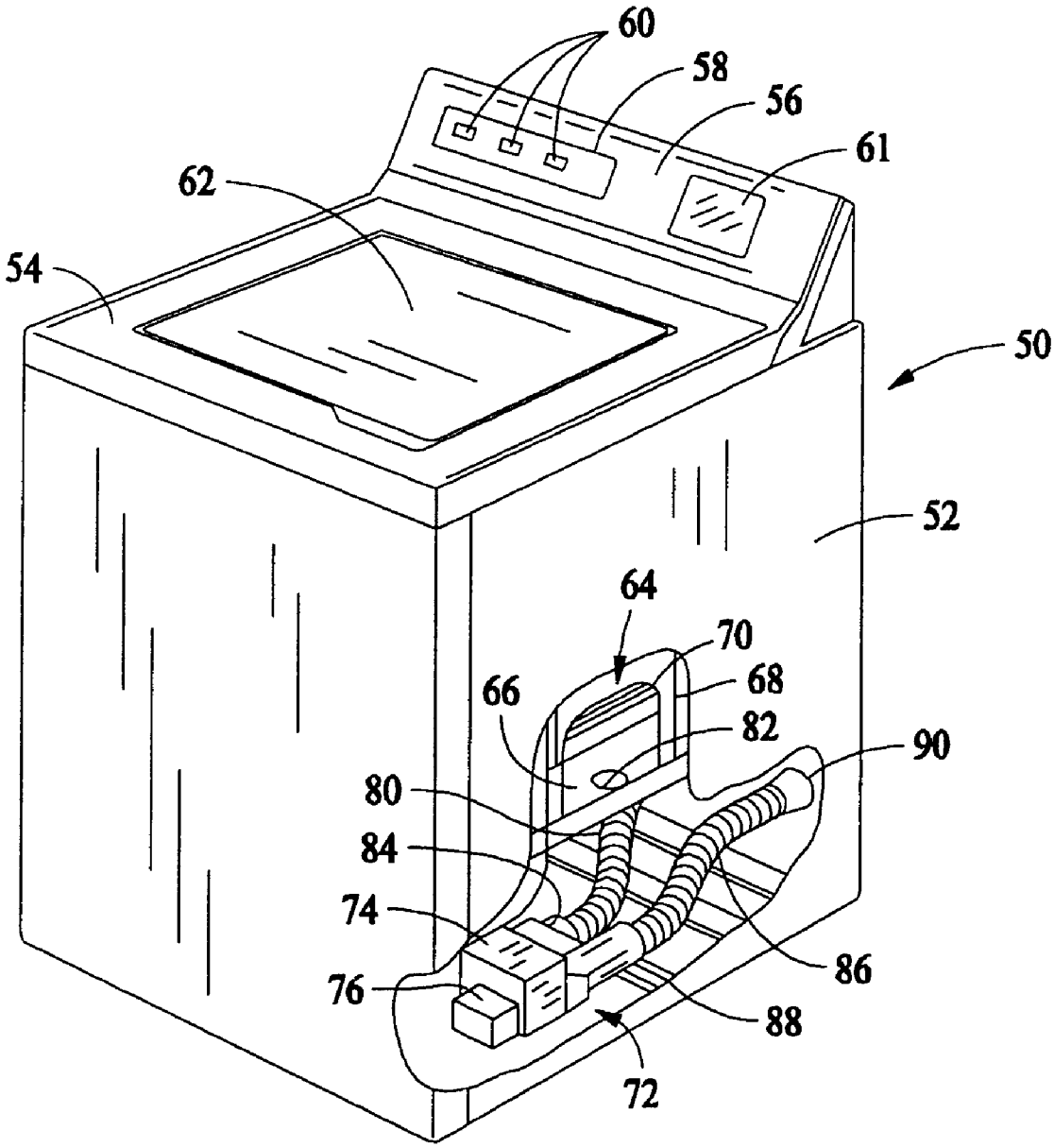
FIG. 1 is a perspective cutaway view of an exemplary washing machine.

FIG. 1 is a perspective view partially broken away of an exemplary washing machine 50 including a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment a display 61 indicates selected features, a countdown timer, and other items of interest to machine users. A lid 62 is mounted to cover 54 and is rotatable about a hinge (not shown) between an open position (not shown) facilitating access to a wash tub 64 located within cabinet 52, and a closed position (shown in FIG. 1) forming a substantially sealed enclosure over wash tub 64. As illustrated in FIG. 1, machine 50 is a vertical axis washing machine.

Tub 64 includes a bottom wall 66 and a sidewall 68, and a basket 70 is rotatably mounted within wash tub 64. A pump assembly 72 is located beneath tub 64 and basket 70 for gravity assisted flow when draining tub 64. Pump assembly 72 includes a pump 74 and a motor 76. A pump inlet hose 80 extends from a wash tub outlet 82 in tub bottom wall 66 to a pump inlet 84, and a pump outlet hose 86 extends from a pump outlet 88 to an appliance washing machine water outlet 90 and ultimately to a building plumbing system discharge line (not shown) in flow communication with outlet 90.

Figure 2:
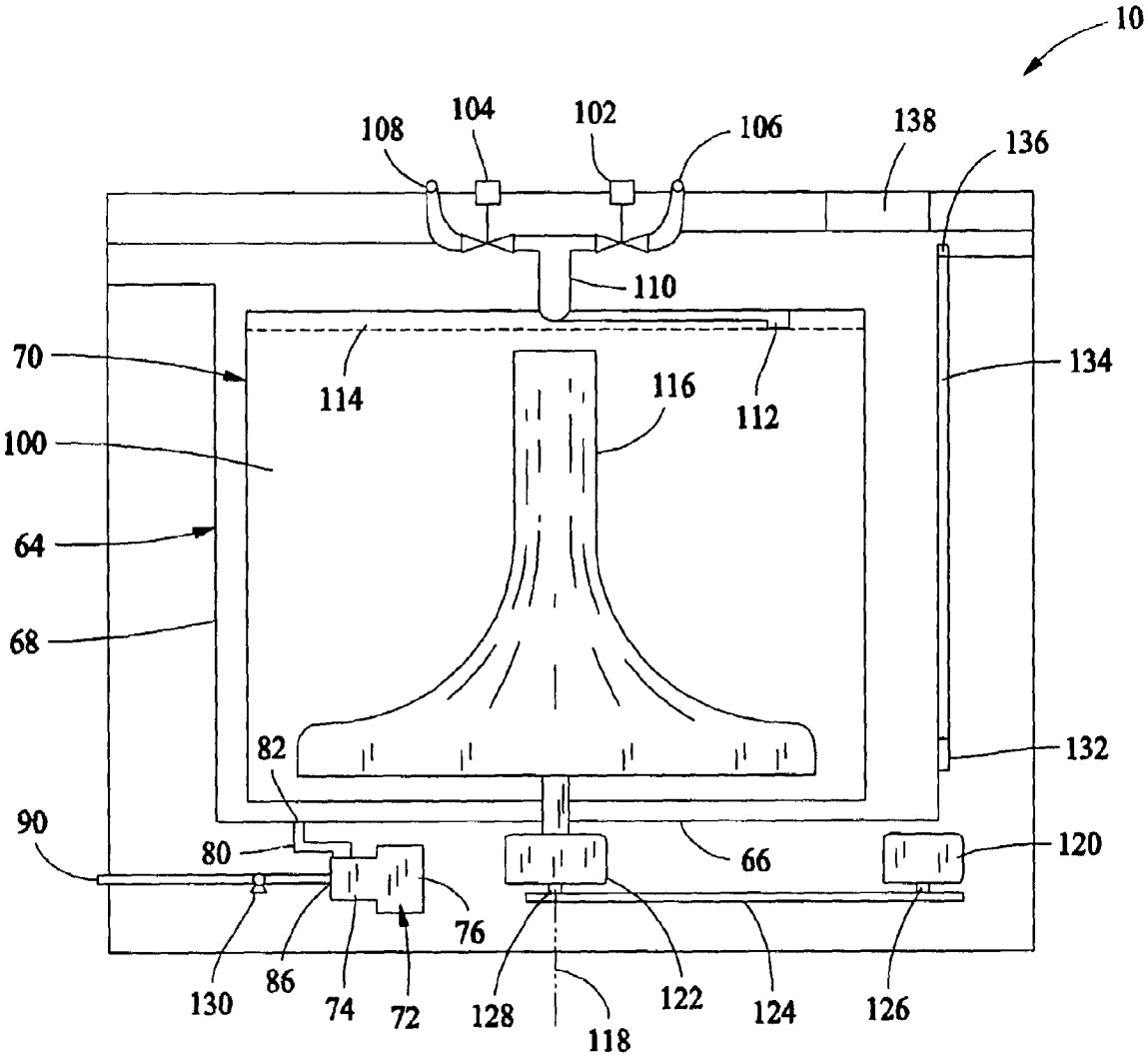
FIG. 2 is front elevational schematic view of the washing machine shown in FIG. 1.

FIG. 2 is a front elevational schematic view of washing machine 50 including wash basket 70 movably disposed and rotatably mounted in wash tub 64 in a spaced apart relationship from tub side wall 64 and tub bottom 66. Basket 70 includes a plurality of perforations therein to facilitate fluid communication between an interior of basket 70 and wash tub 64.

A hot liquid valve 102 and a cold liquid valve 104 deliver fluid, such as water, to basket 70 and wash tub 64 through a respective hot liquid hose 106 and a cold liquid hose 108. Liquid valves 102, 104 and liquid hoses 106, 108 together form a liquid supply connection for washing machine 50 and, when connected to a building plumbing system (not shown), provide a fresh water supply for use in washing machine 50. Liquid valves 102, 104 and liquid hoses 106, 108 are connected to a basket inlet tube 110, and fluid is dispersed from inlet tube 110 through a known nozzle assembly 112 having a number of openings therein to direct washing liquid into basket 70 at a given trajectory and velocity. A known dispenser (not shown in FIG. 2), may also be provided to produce a wash solution by mixing fresh water with a known detergent or other composition for cleansing of articles in basket 70.

In an alternative embodiment, a known spray fill conduit 114 (shown in phantom in FIG. 2) may be employed in lieu of nozzle assembly 112. Along the length of the spray fill conduit 114 are a plurality of openings arranged in a predetermined pattern to direct incoming streams of water in a downward tangential manner towards articles in basket 70. The openings in spray fill conduit 114 are located a predetermined distance apart from one another to produce an overlapping coverage of liquid streams into basket 70. Articles in basket 70 may therefore be uniformly wetted even when basket 70 is maintained in a stationary position.

A known agitation element 116, such as a vane agitator, impeller, auger, or oscillatory basket mechanism, or some combination thereof is disposed in basket 70 to impart an oscillatory motion to articles and liquid in basket 70. In different embodiments, agitation element 116 may be a single action element (i.e., oscillatory only), double action (oscillatory movement at one end, single direction rotation at the other end) or triple action (oscillatory movement plus single direction rotation at one end, singe direction rotation at the other end). As illustrated in FIG. 2, agitation element 116 is oriented to rotate about a vertical axis 118.

Basket 70 and agitator 116 are driven by motor 120 through a transmission and clutch system 122. A transmission belt 124 is coupled to respective pulleys of a motor output shaft 126 and a transmission input shaft 128. Thus, as motor output shaft 126 is rotated, transmission input shaft 128 is also rotated. Clutch system 122 facilitates driving engagement of basket 70 and agitation element 116 for rotatable movement within wash tub 64, and clutch system 122 facilitates relative rotation of basket 70 and agitation element 116 for selected portions of wash cycles. Motor 120, transmission and clutch system 122 and belt 124 collectively are referred herein as a machine drive system.

Washing machine 50 also includes a brake assembly (not shown) selectively applied or released for respectively maintaining basket 70 in a stationary position within tub 64 or for allowing basket 70 to spin within tub 64. Pump assembly 72 is selectively activated, in the example embodiment, to remove liquid from basket 70 and tub 64 through drain outlet 90 and a drain valve 130 during appropriate points in washing cycles as machine 50 is used. In an exemplary embodiment, machine 50 also includes a reservoir 132, a tube 134 and a pressure sensor 136. As fluid levels rise in wash tub 64, air is trapped in reservoir 132 creating a pressure in tube 134 that pressure sensor 136 monitors. Liquid levels, and more specifically, changes in liquid levels in wash tub 64 may therefore be sensed, for example, to indicate laundry loads and to facilitate associated control decisions. In further and alternative embodiments, load size and cycle effectiveness may be determined or evaluated using other known indicia, such as motor spin, torque, load weight, motor current, and voltage or current phase shifts.

Operation of machine 50 is controlled by a controller 138 which is operatively coupled to the user interface input located on washing machine backsplash 56 (shown in FIG. 1) for user manipulation to select washing machine cycles and features. In response to user manipulation of the user interface input, controller 138 operates the various components of machine 50 to execute selected machine cycles and features.

In an illustrative embodiment, clothes are loaded into basket 70, and washing operation is initiated through operator manipulation of control input selectors 60 (shown in FIG. 1). Tub 64 is filled with water and mixed with detergent to form a wash fluid, and basket 70 is agitated with agitation element 116 for cleansing of clothes in basket 70. That is, agitation element is moved back and forth in an oscillatory back and forth motion. In the illustrated embodiment, agitation element 116 is rotated clockwise a specified amount about the vertical axis of the machine, and then rotated counterclockwise by a specified amount. The clockwise/counterclockwise reciprocating motion is sometimes referred to as a stroke, and the agitation phase of the wash cycle constitutes a number of strokes in sequence. Acceleration and deceleration of agitation element 116 during the strokes imparts mechanical energy to articles in basket 70 for cleansing action. The strokes may be obtained in different embodiments with a reversing motor, a reversible clutch, or other known reciprocating mechanism.

After the agitation phase of the wash cycle is completed, tub 64 is drained with pump assembly 72. Clothes are then rinsed and portions of the cycle repeated, including the agitation phase, depending on the particulars of the wash cycle selected by a user.

Figure 3:
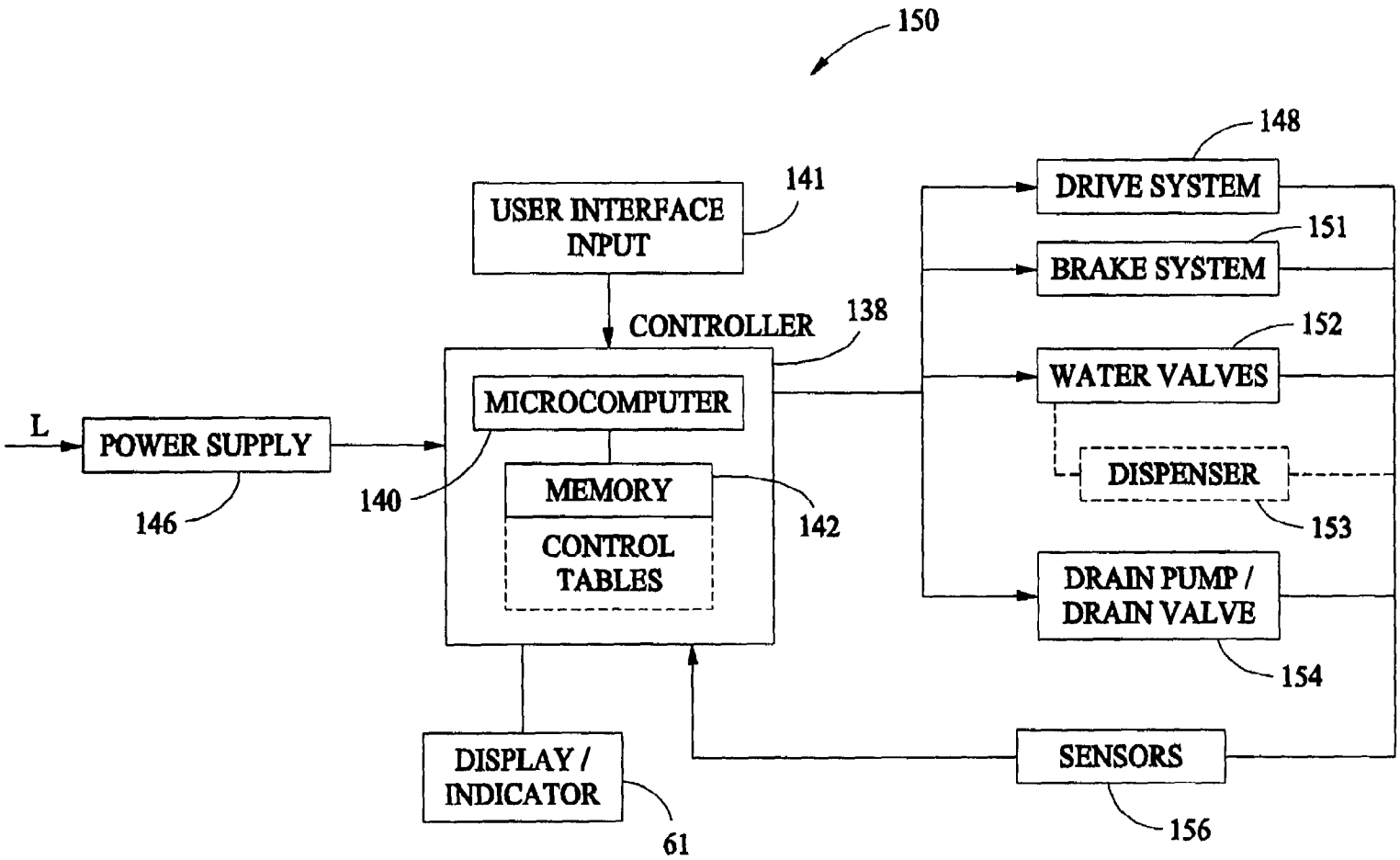
FIG. 3 is a schematic block diagram of a control system for the washing machine shown in FIGS. 1 and 2.

FIG. 3 is a schematic block diagram of an exemplary washing machine control system 150 for use with washing machine 50 (shown in FIGS. 1 and 2). Control system 150 includes controller 138 which may, for example, be a microcomputer 140 coupled to a user interface input 141. An operator may enter instructions or select desired washing machine cycles and features via user interface input 141, such as through input selectors 60 (shown in FIG. 1) and a display or indicator 61 coupled to microcomputer 140 displays appropriate messages and/or indicators, such as a timer, and other known items of interest to washing machine users. A memory 142 is also coupled to microcomputer 140 and stores instructions, calibration constants, and other information as required to satisfactorily complete a selected wash cycle. Memory 142 may, for example, be a random access memory (RAM). In alternative embodiments, other forms of memory could be used in conjunction with RAM memory, including but not limited to flash memory (FLASH), programmable read only memory (PROM), and electronically erasable programmable read only memory (EEPROM).

Power to control system 150 is supplied to controller 138 by a power supply 146 configured to be coupled to a power line L. Analog to digital and digital to analog converters (not shown) are coupled to controller 138 to implement controller inputs and executable instructions to generate controller output to washing machine components such as those described above in relation to FIGS. 1 and 2. More specifically, controller 138 is operatively coupled to machine drive system 148 (e.g., motor 120, clutch system 122, and agitation element 116 shown in FIG. 2), a brake assembly 151 associated with basket 70 (shown in FIG. 2), machine water valves 152 (e.g., valves 102, 104 shown in FIG. 2) and machine drain system 154 (e.g., drain pump assembly 72 and/or drain valve 130 shown in FIG. 2). In a further embodiment, water valves 152 are in flow communication with a dispenser 153 (shown in phantom in FIG. 3) so that water may be mixed with detergent or other composition of benefit to washing of garments in wash basket 70.

In response to manipulation of user interface input 141 controller 138 monitors various operational factors of washing machine 50 with one or more sensors or transducers 156, and controller 138 executes operator selected functions and features according to known methods. Of course, controller 138 may be used to control washing machine system elements and to execute functions beyond those specifically described herein. Controller 138 operates the various components of washing machine 50 in a designated wash cycle familiar to those in the art of washing machines.

Figure 4:
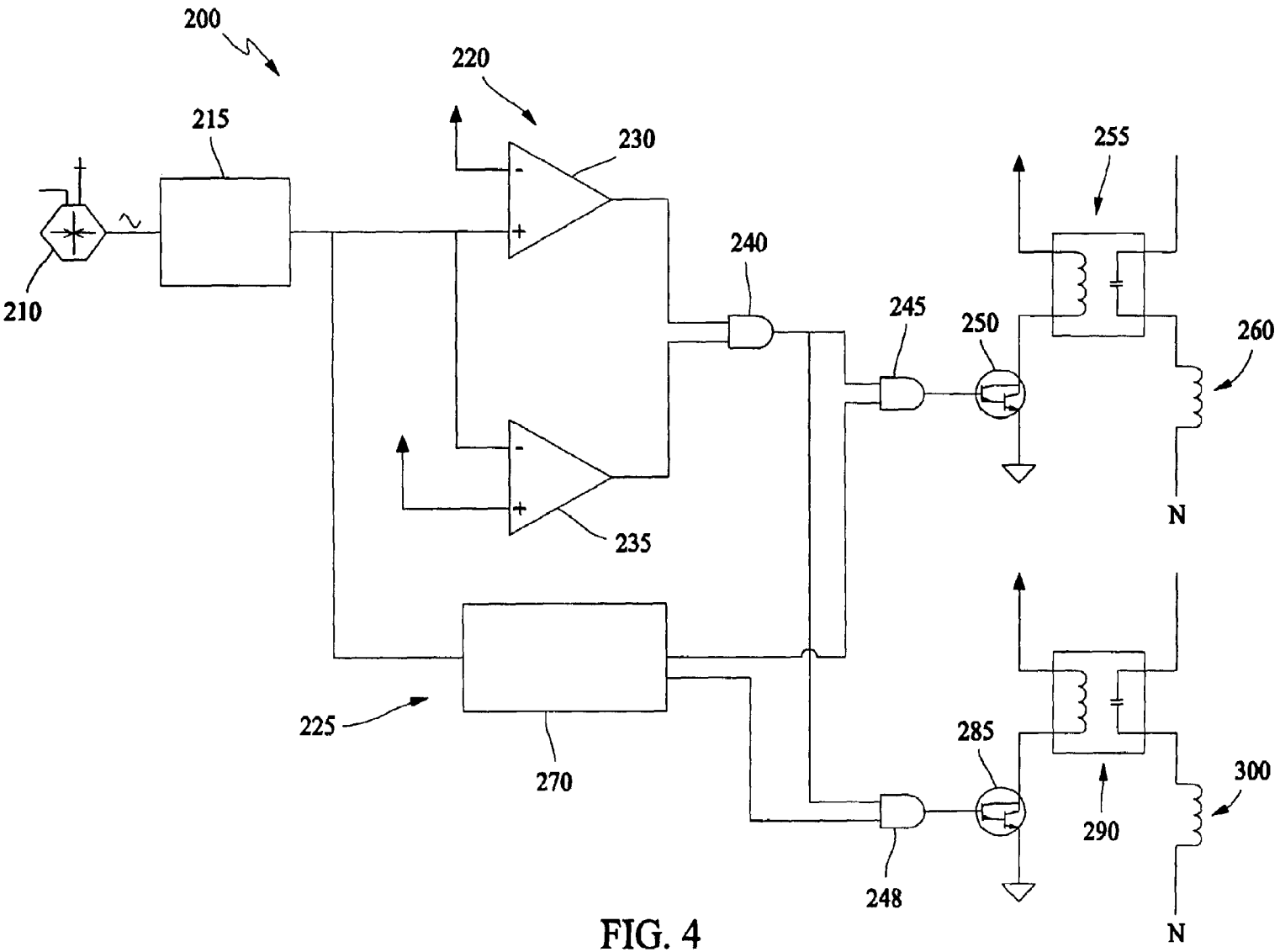
FIG. 4 is a schematic diagram of a over fill protection circuit for the washing machine shown in FIGS. 1 and 2.

FIG. 4 is a schematic of a washer overfill protection circuit 200. Washer overfill protection circuit 200 includes a pressure sensor 210 electrically coupled to a frequency to voltage converter 215. The output of frequency to voltage converter 215 is electrically coupled to at least a first circuit 220 and a second circuit 225. In the exemplary embodiment, first circuit 220 is a back up circuit 220 and includes a first operational amplifier (op amp) 230 and a second op amp 235. In one embodiment, first op amp 230 is a overfill comparator 230 and second op amp 235 is a sensor error comparator 235. Overfill comparator 230 and sensor error comparator 235 are electrically coupled to a first gate 240. First gate 240 is electrically coupled to a second gate 245 and a third gate 248. Second gate 245 is electrically coupled to a first transistor 250, such as a bipolar junction transistor. First transistor 250 is electrically coupled to a first relay driver 255. First relay driver 255 is electrically coupled to a fluid valve coil 260, such as a hot water valve coil 260.

Second circuit 225 includes a microprocessor 270. Microprocessor 270 is electrically coupled to second gate 245 of back up circuit 220 and a third gate 248. Third gate 248 is electrically coupled to a second transistor 285, such as a bipolar junction transistor. Second transistor 285 is electrically coupled to a second relay driver 290. Second relay driver 290 is electrically coupled to a fluid valve coil 300, such as a cold water valve coil 300.

Microprocessor 270 is programmed to perform functions described herein, and as used herein, the term microprocessor is not limited to just those integrated circuits referred to in the art as microprocessor, but broadly refers to computers, processors, microcontrollers, microcomputers, programmable logic controllers, application specific integrated circuits, and other programmable circuits, and these terms are used interchangeably herein.

Pressure sensor 210 generates a variable frequency signal that is proportional to the water level in washer tub 64. Frequency to voltage converter 215 generates an analog voltage that is proportional to the frequency from the output of pressure sensor 210. The analog voltage is then input to microprocessor 270. Microprocessor 270 uses the analog voltage to calculate the water level and sends, for example, a hot water valve command signal to turn on and off hot water valve coil 260. The hot water valve command and pressure sensor check signal are sent to the input of second gate 245. If hot water command is high and the pressure sensor check signal is high, the output of second gate 245 is high, turning on first transistor 250. If first transistor 250 is on, first relay driver 255 is energized, closing the normally closed contact for first relay driver 255 energizing hot water valve coil 260. Energizing hot water valve coil 260 opens the hot water valve (not shown), allowing hot water to flow into washer tub 64. If the hot water valve command and/or the pressure sensor check signal is low, the output of second gate 245 is low, turning off first transistor 250. If first transistor 250 is off, first relay driver 255 is de-energized, opening the normally open contacts of first relay driver 255, de-energizing hot water valve coil 260. De-energizing hot water valve coil 260 shuts off the hot water valve, blocking hot water from entering the washer tub 64.

The output of the frequency to voltage converter 215 is input into overfill comparator 230 and compared with an over fill reference voltage. If the frequency to voltage converter 215 output is less than the over fill reference voltage, the overfill comparator 230 output is high, indicating a normal tub water level. If the frequency to voltage converter 215 output is greater than the over fill reference voltage, the overfill comparator 230 output is low, indicating an over fill condition.

The output of the frequency to voltage converter 215 is also an input into sensor error comparator 235 and compared with a sensor error voltage. If the frequency to voltage converter 215 output is greater than the sensor error voltage, the sensor error comparator 235 output is high indicating a valid pressure sensor signal. If the frequency to voltage converter 215 output is less than the sensor error voltage, the sensor error comparator 235 output is low indicating an invalid pressure sensor signal.

Overfill comparator 230 output and sensor error comparator 235 output are connected to the input of first gate 240. If overfill comparator 230 output and/or sensor error comparator 235 output is low, first gate 240 output is low. If the output of first gate 240 is low, second gate 245 and third gate 248 outputs are low, de-energizing first transistor 250 and second transistor 285. De-energizing first transistor 250 and second transistor 285 de-energizes first relay driver 255 and second relay driver 290, respectfully, de-energizing hot and cold water valve coils 260 and 300, respectfully. De-energizing hot and cold water valve coils 260 and 300, blocks the hot and cold water from entering washer tub 64.

In one embodiment, pressure sensor 210 may output an analog voltage instead of a frequency signal, thereby removing frequency to voltage converter 215 from circuit 200. In another embodiment, the logic performed by first, second, and third gates 240, 245, and 248 may be performed by other logic that generates the same operation. In addition, the water valve driver circuits may be generated by any other switching device. In a further embodiment, hot and cold water valve coils 260 and 300 may be replaced by dc water valves, using a dc drive circuit instead of first and second relay drivers 255 and 290.

While the invention has been described in terms of various specific embodiments, those skilled in the art will recognize that the invention can be practiced with modification within the spirit and scope of the claims.

What is claimed is:

1. A circuit comprising:

a processor programmed to prevent overfilling of a cabinet with a fluid;

a pressure sensor operatively coupled to said processor; and a backup circuit having fixed logic, said backup circuit electrically coupled to said processor to redundantly prevent overfilling the cabinet with the fluid, said backup circuit including a first comparator that compares the signal from said pressure sensor with an overfill reference signal to indicate an overfill condition and a second comparator that compares the signal from said pressure sensor to a sensor error voltage to indicate an invalidity of the signal from said pressure sensor, said backup circuit acting independently of said processor to disable a flow of fluid to the cabinet when the overfill condition is indicated, and said backup circuit acting independently of said processor to disable a flow of fluid to the cabinet when the invalidity of the signal is indicated.

2. A circuit according to claim 1, wherein said pressure sensor is electrically coupled to said backup circuit for measuring a fluid level in the cabinet, said pressure sensor generates a signal that is proportional to the fluid level.

3. A circuit according to claim 2, wherein said processor calculates the fluid level based on the signal from said pressure sensor.

4. A circuit according to claim 1, wherein said backup circuit acts independently of said processor to disable a flow of fluid to the cabinet when the overfill condition is indicated to close a valve for filling said cabinet when the signal from said pressure sensor is greater than said overfill reference signal.

5. A circuit according to claim 1, wherein said backup circuit acts independently of said processor to disable a flow of fluid to the cabinet when the invalidity of the signal is indicated to close a valve for filling said cabinet when the signal from said pressure sensor is less than said sensor error signal.

6. A washer overfill protection system comprising:

a pressure sensor configured to generate a variable frequency signal that is proportional to the fluid level of the washer;

a converter electrically coupled to said pressure sensor, said converter configured to generate voltage that is proportional to the frequency of the output of said pressure sensor;

a microprocessor electrically coupled to said converter, said microprocessor configured to calculate the fluid level from the voltage of said converter, said microprocessor is electrically coupled to a fluid valve, said fluid valve including a coil; and a backup circuit having fixed logic, said backup circuit electrically coupled to said converter and said fluid valve, said backup circuit is configured to at least one of turn on said fluid valve and turn off said fluid valve when said microprocessor fails, said backup circuit including an overfill comparator that compares the signal from said pressure sensor with an overfill reference signal to indicate an overfill condition and a sensor error comparator that compares the signal from said pressure sensor to a sensor error voltage to indicate an invalidity of the signal from said pressure sensor, said backup circuit acting independently of said microprocessor to disable a flow of fluid to the washer when the overfill condition is indicated, and said backup circuit acting independently of said microprocessor to disable a flow of fluid to the washer when the invalidity of the signal is indicated.

7. A washer overfill protection system according to claim 6, wherein said overfill comparator is electrically coupled to said fluid valve.

8. A washer overfill protection circuit according to claim 7, wherein said fluid valve coil is energized when said converter output voltage is less than the overfill reference voltage.

9. A washer overfill protection system according to claim 6, wherein said sensor error comparator is electrically coupled to said fluid valve.

10. A washer overfill protection circuit according to claim 9, wherein said fluid valve coil is energized when said converter output voltage is greater than the sensor error voltage.

11. A washer overfill protection circuit according to claim 9, wherein said fluid valve coil is de-energized when said converter output voltage is lower than the sensor error voltage.

12. A washer overfill protection circuit according to claim 7, wherein said fluid valve coil is de-energized when said converter output voltage is greater than the overfill reference voltage.

13. A washing machine comprising:

a cabinet;

a tub and basket mounted within said cabinet;

a pressure sensor coupled to said cabinet;

a cold water valve for controlling a cold water flow to said tub;

a hot water valve for controlling a hot water flow to said tub; and a circuit coupled to at least one of said hot water valve and said cold water valve to control opening and closing of said hot and cold water valves, said circuit including a processor programmed to prevent overfilling of said cabinet and a backup circuit having fixed logic, said backup circuit electrically coupled to said processor to redundantly prevent overfilling said cabinet, said backup circuit including an overfill comparator that compares the signal from said pressure sensor with an overfill reference signal to indicate an overfill condition and a sensor error comparator that compares the signal from said pressure sensor to a sensor error voltage to indicate an invalidity of the signal from said pressure sensor, said backup circuit acting independently of said processor to disable at least one of the cold water flow and the hot water flow to the cabinet when the overfill condition is indicated, and said backup circuit acting independently of said processor to disable at least one of the cold water flow and the hot water flow to the cabinet when the invalidity of the signal is indicated.

14. A washing machine according to claim 13, wherein said pressure sensor is electrically coupled to said backup circuit for measuring a fluid level in said cabinet, said pressure sensor generates a signal that is proportional to the fluid level.

15. A washing machine according to claim 14, wherein said processor calculates the fluid level based on the signal from said pressure sensor.

16. A washing machine according to claim 14, wherein said overfill comparator comprises a first operation amplifier for comparing the signal from said pressure sensor with said overfill reference signal and said sensor error comparator comprises a second operation amplifier for comparing the signal from said pressure sensor with said sensor error voltage.

17. A washing machine according to claim 13, wherein said backup circuit acts independently of said processor to disable at least one of the cold water flow and the hot water flow to the cabinet when the overfill condition is indicated to close at least one of said cold water valve and said hot water valve if the signal from said pressure sensor is greater than the overfill reference signal.

18. A washing machine according to claim 13, wherein said backup circuit acts independently of said processor to disable at least one of the cold water flow and the hot water flow to the cabinet when the invalidity of the signal is indicated to close at least one of said cold water valve and said hot water valve for filling said cabinet if the signal from said pressure sensor is less than the sensor error signal.

* * * * *